US005632172A

United States Patent [19]

Käsmacher

[11] Patent Number: 5,632,172

[45] Date of Patent: May 27, 1997

[54] METHOD AND DEVICE FOR FORMING SHEET METAL

[75] Inventor: Harald Käsmacher, St. Leon-Rot, Germany

[73] Assignees: SMG Suddeutsche Maschinenbau GmbH, Waghausel; Schuler Werkzeuge GmbH & Co., Goppingen, both of Germany

[21] Appl. No.: 530,726

[22] Filed: Sep. 19, 1995

[30] Foreign Application Priority Data

Sep. 29, 1994 [DE] Germany ..... 44 34 799.5

[51] Int. Cl.[6] ..... B21D 22/10

[52] U.S. Cl. ..... 72/60

[58] Field of Search ..... 72/54, 60

[56] References Cited

U.S. PATENT DOCUMENTS

| | | | |
|---|---|---|---|
| 3,632,347 | 1/1972 | Burk | 72/60 |
| 4,045,986 | 9/1977 | Laycock et al. | 72/60 |
| 4,409,808 | 10/1983 | Festag et al. | 72/60 |
| 4,409,809 | 10/1983 | Buchanan | 72/60 |

FOREIGN PATENT DOCUMENTS

| | | | |
|---|---|---|---|
| 0231677 | 11/1986 | European Pat. Off. . | |
| 2117950 | 10/1972 | Germany | 72/60 |
| 2640591 | 9/1976 | Germany . | |
| 2711616 | 9/1978 | Germany | 72/60 |
| 56-144837 | 4/1980 | Japan . | |
| 245921 | 11/1986 | Japan | 72/60 |
| 5212464 | 2/1992 | Japan . | |
| 1461317 | 9/1974 | United Kingdom . | |

*Primary Examiner*—David Jones

*Attorney, Agent, or Firm*—Antonelli, Terry, Stout & Kraus, LLP

[57] ABSTRACT

A method and apparatus for shaping a sheet metal blank into a shaped outline is disclosed. The blank is clamped hydraulically between an upper tool and a lower tool with one of the tools having the shaped outline. Hydraulic pressure acts on a side of the sheet metal blank opposite the shaped outline to force the sheet metal blank into the shaped outline. The sheet metal blank, under the controlled action of the hydraulic pressure, is initially preformed to an extension of 10–15% of initial dimensions of the sheet metal blank and then, with continuing hydraulic pressure, the sheet metal blank is finally shaped by drawing without further extension until the sheet metal blank completely conforms to the shaped outline.

16 Claims, 3 Drawing Sheets

METHOD AND DEVICE FOR FORMING SHEET METAL

BACKGROUND OF THE INVENTION

1. Field of the Invention

The invention relates to a method for forming sheet metal, in which a blank is clamped in a parting plane between an upper tool and a lower tool with one of the tools having a shaped outline. The sheet metal is formed by an action of a hydraulic pressure medium acting against the sheet metal on a side opposite the shaped outline.

2. Description of the Prior Art

In addition to conventional mechanical deep-drawing for shaping sheet metal, methods are also known in which the acting medium is a hydraulic pressure medium. Thus, for example, in the so-called Hydro-Mec drawing method a sheet metal blank clamped between a sheet holder (hold-down device) and a drawing ring is forced by means of a shaping die, with the outline of the finished shaped part (workpiece), into a matching opposite tool, called a "water tank", in which the pressure medium is located and from which the pressure medium is forced (displaced) as the shaping die advances. This method has the advantage over purely mechanical drawing methods that the sheet metal blank is forced outward in the vicinity of the drawing radius of the drawing ring and consequently is not pulled over the drawing radius to avoid particularly high stress on the sheet metal blank. In addition, the exterior remains largely free of drawing marks. This method is not suitable for flat shaped parts with only a slight contour as a consequence of the finished shaped part (workpiece) having little dimensional stability.

Stretch forming produces flat shaped parts with a comparatively small wall thickness, in which the blank is clamped tightly between an upper tool and a lower tool. One of the tools has the desired shaped contour while the other tool is connected to a controllable hydraulic source. By acting on the blank on the side opposite the shaped contour, the blank is forced into the other tool. The forming is totally produced by stretching the sheet metal. The method is very limited both with regard to the degree of shaping and the thickness of the sheet that can be shaped.

Reverse stretch drawing is used to shape deeper contours in which one tool has a preform with less contouring while the other tool has the final shaped contour with both tools being activated by a pressure medium. The firmly clamped sheet metal blank is initially shaped by the pressure medium into the preformed tool and then given its final shaped contour by applying pressure from the other side. This method is very expensive to perform both in terms of tools and machinery.

SUMMARY OF THE INVENTION

The object of the invention is to provide a method and a device which in particular allows manufacturing of flat shaped workpieces with shallow contours having good dimensional stability.

In a method in which the shaping is performed by an actively acting hydraulic pressure medium, the invention initially preforms the sheet metal blank under the controlled action of the pressure medium up to an extension (stretching) of 10–15% of initial dimensions of the sheet metal blank in the direction of the shaped outline, and then pressure is continued while freely drawing the sheet without further extension until it has the desired shaped outline.

The method according to the invention therefore operates essentially in two steps, with stretching of 10–15% of initial dimensions (e.g. length and width) of the sheet metal blank in a preforming phase by controlled application of pressure so that the sheet metal blank essentially bends as membrane with a greatest curvature in a central area thereof. The process of stretching conforms to Hooke's law. During subsequent final shaping, while continuing pressure is applied with the pressure medium, the sheet is finally formed without further stretching until it has the desired shaped outline.

In this manner, even large-area shallow contoured shaped workpieces, for example, engine hoods or trunk lids or even roof parts of motor vehicles, can be produced without the shaped parts being "limp" and sensitive to vibration. In addition, shallow shaped parts can be manufactured in a dimensionally accurate fashion and, in particular, sheets can be processed that already have a finished surface to produce shaped parts with complicated demanding finished surfaces.

The stretching of the initial dimensions that is desired in the preforming phase can be implemented in different ways. In one embodiment of the method according to the invention, the shape of the outline is adjusted at the beginning of the preforming process to a minimum distance from the parting plane so that the blank contacts the shaped outline throughout an area.

In this embodiment, therefore, the sheet is curved during the preforming process to contact the projecting parts of the shaped outline with the distance of the shaped outline from the parting plane being adjusted so that contact takes place approximately at the moment when the stretching beyond the initial dimensions of the sheet metal blank of 10–15% has been reached, and during the subsequent drawing process, the sheet metal is shaped to the desired shaped outline.

In the method referred to above, the maximum mold depth is determined by, among other things, a minimum distance set for preforming between the shaped outline and the parting plane. It may be that in a marginal area of deeper contours the shaped part must then be trimmed which entails a corresponding waste of material. Therefore also according to the invention, the shaped outline is moved in the direction of the parting plane during final shaping. As a result, the mold depth is reduced until it is close to the desired dimension so that the shaped part no longer has to be trimmed which produces a very small waste of material. This variation on the method also prevents further stretching after the preforming process is complete.

The desired stretching can be achieved very simply if the blank is firmly clamped between the upper and lower tools during preforming while during final shaping by drawing the clamp is released to the point where the sheet can freely be drawn. In this variation on the method, therefore, it is mainly stretching that takes place in the preforming process, while typical deep-drawing occurs during final forming.

The invention also relates to a device for shaping a sheet metal blank comprising an upper tool and a lower tool with one of the tools having a shaped outline and the other tool being connected with a controllable hydraulic source with the sheet metal blank being clamped in a fluid tight manner at the parting plane of the tools. The practice of the invention is achieved with the tool having the shaped outline made in two parts and having a drawing ring cooperating with the other tool and a shaping die that has the shaped outline and is movable relative to the parting plane.

One preferred embodiment of the invention positions the shaping die during the initial preforming of the sheet metal blank at a position relative to the parting plane to contact the metal blank through an area of the metal blank until producing a stretching of 10–15% beyond the initial dimensions of the sheet metal blank and, thereafter, moving the shaping die during final drawing in the direction away from the parting plane to complete shaping of the sheet metal blank to the desired shaped outline.

It is possible, without difficulty, to stretch the sheet metal blank by 10–15% beyond its initial dimensions and then deep draw the sheet metal blank to achieve final shaping.

The distance from the drawing ring to the opposite tool is adjustable to control the clamping force that grips the blank edgewise. For example, the blank can be tightly clamped during the initial preforming of the sheet metal blank and the clamping force can be released during the drawing to produce the final shaped contour to allow the sheet metal blank to freely follow the drawing movement.

DESCRIPTION OF THE PREFERRED EMBODIMENTS

Figure 1:
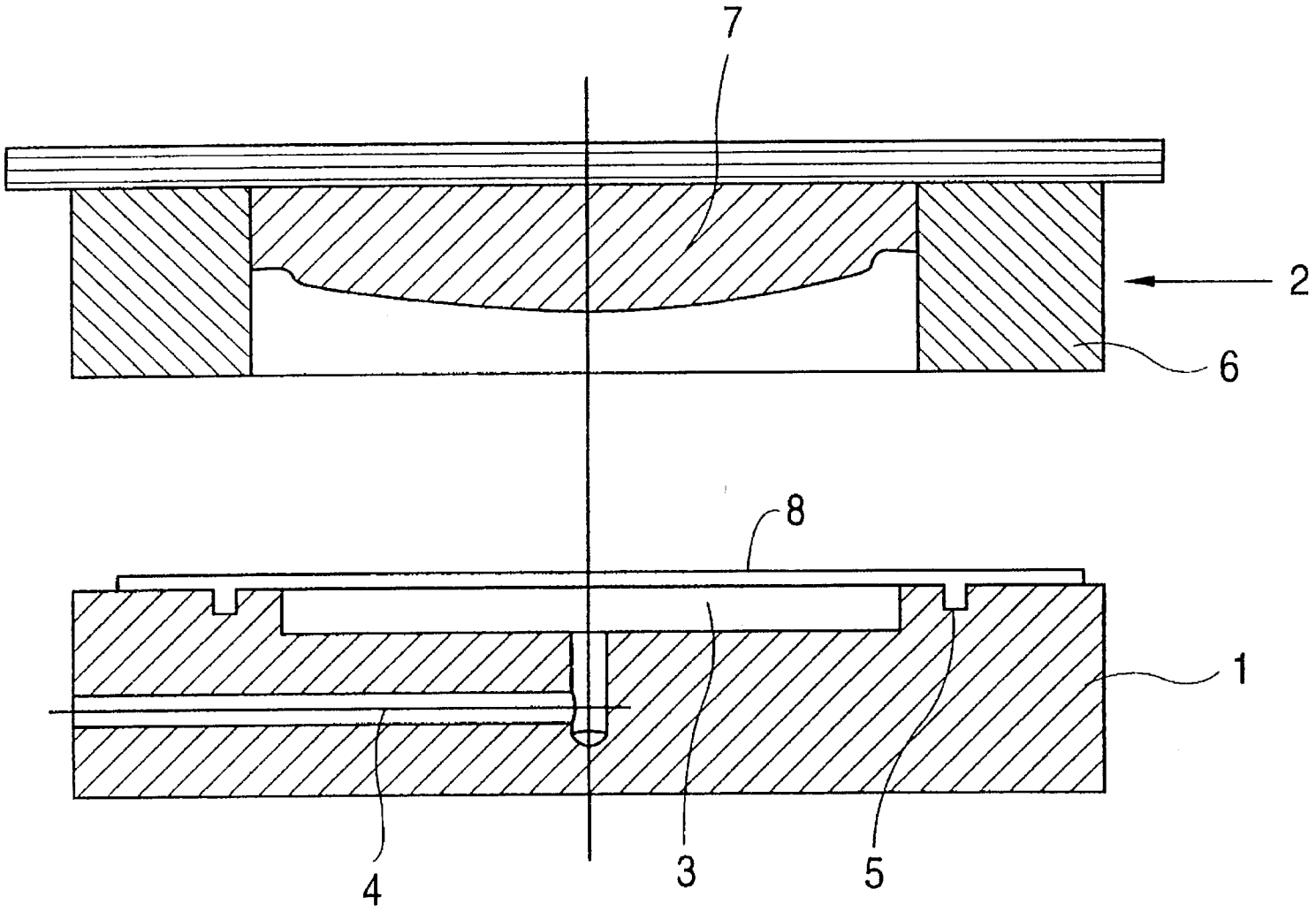
FIG. 1 is a section through an embodiment of the invention in an opened state.

The device shown in the drawing has a lower tool 1 and an upper tool 2. The lower tool 1 has a chamber 3 on its upper surface that in connected by a line 4 to a controllable hydraulic source. In addition, a circular liquid seal 5 is mounted on the top of lower tool 1 to facilitate fluid tight clamping of the sheet metal blank between the lower tool 1 and the upper tool 2.

The upper tool 2 has two parts. The first part is a drawing ring 6 and the second part is a shaping die 7 that has the shaped outline. The shaped outline may be flat or slightly convex as illustrated and is intended for making a shaped part with a large surface area. This can be, for example, an engine hood or roof of an automobile or another sheet metal part with a large surface area.

Figure 2:
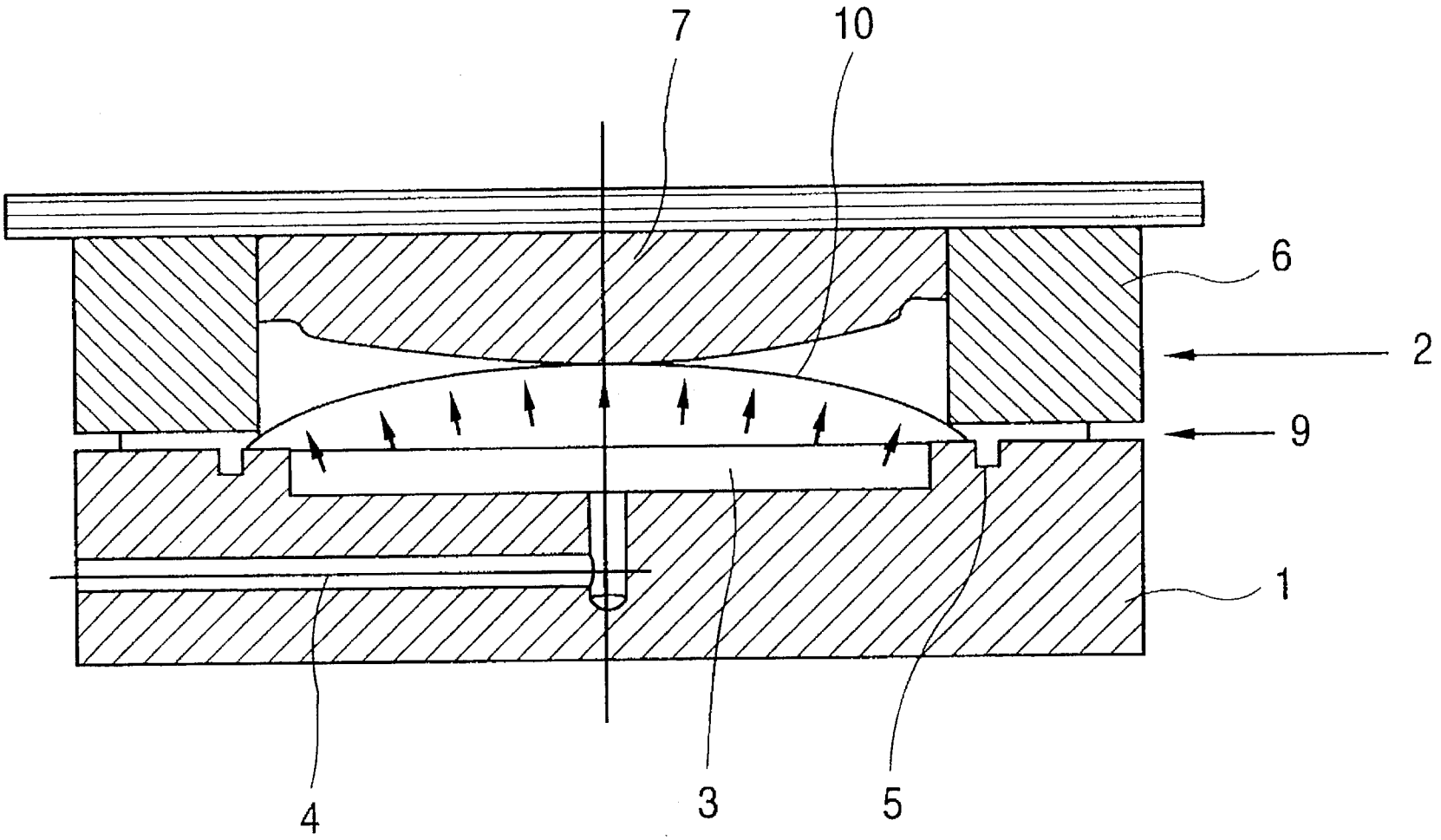
FIG. 2 is a section corresponding to FIG. 1 with the tools closed in the preform phase.

Sheet metal blank 8 in placed on the lower tool 1. The lower tool 1 and upper tool 2 are then brought together until the sheet metal blank 8 is clamped in a parting plane 9, as illustrated in FIG. 2, between drawing ring 6 and the top of lower tool 1 while, at the same time, seal 5 seals off the interior with a fluid tight seal. Then fluid pressure is introduced in a controlled manner into chamber 3 through line 4, as indicated by the arrows, so that the sheet metal blank 8 is curved to form a membrane 10. The projection of the drawing ring 6 with regard to the highest point on the shaped outline at shaping die 7 is designed so that after the preforming step shown in FIG. 2 is completed, the sheet metal blank 8 has been stretched about 10–15% beyond its initial dimensions, until it contacts the shaped outline in the area of its highest point. The process of stretching, which produces the stretching beyond the initial dimensions of the sheet metal blank 8, conforms to Hooke's law. This stretching can be adjusted very precisely both by appropriate control of the pressure medium and by controlling the clamping force in parting plane 9.

Figure 3:
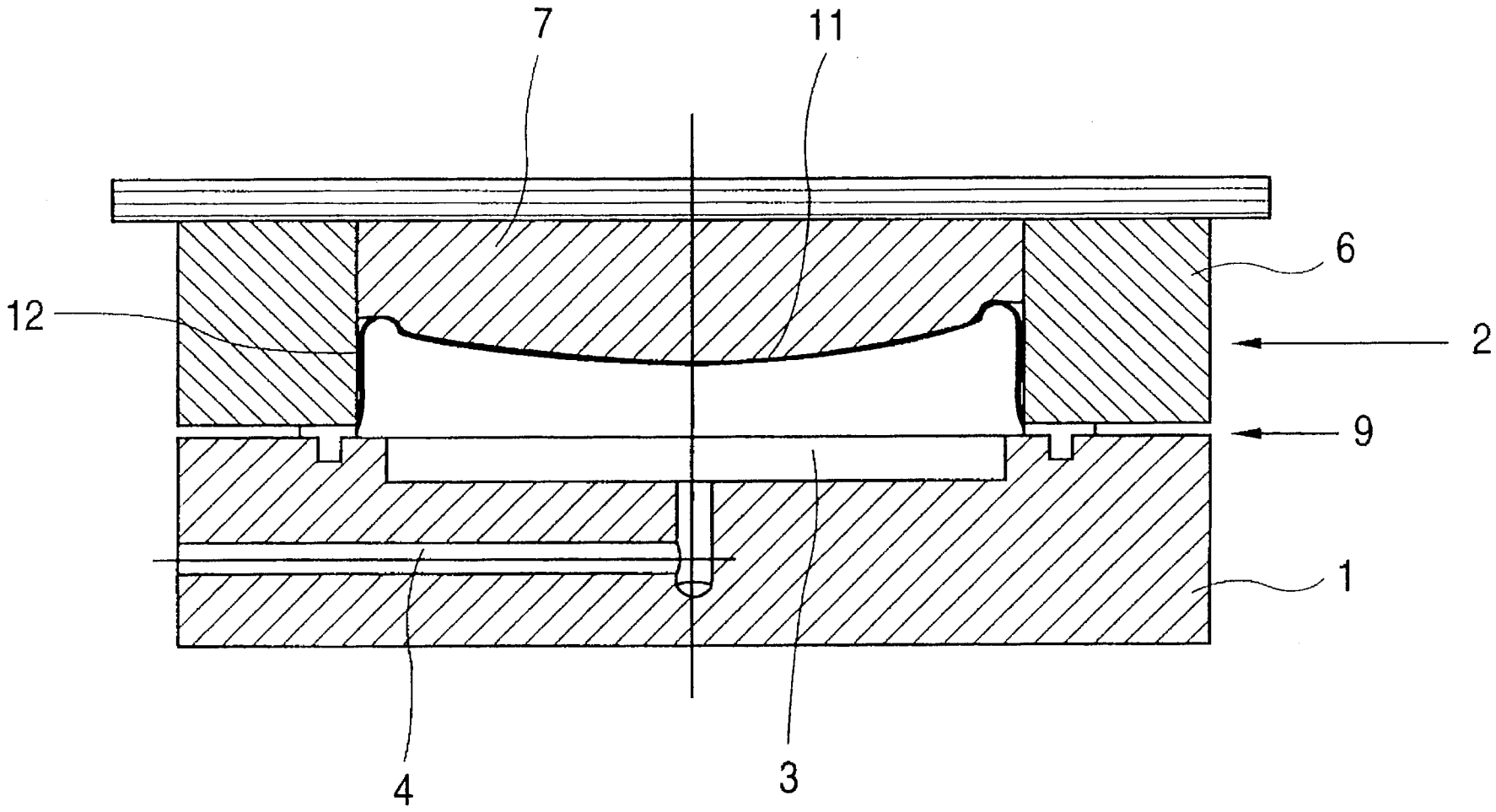
FIG. 3 is a section corresponding to FIG. 2 after completion of the shaping process.

With further pressurization, the sheet metal blank 8 is finally formed by drawing to be shaped to the complete outline of shaping die 7, as shown in FIG. 3. Meanwhile, the clamping force can be reduced under control if desired, so that the sheet can freely be drawn in the parting plane 9, without any further stretching of the sheet metal in the final forming phase, and finally the shaped sheet metal part 11 shown in FIG. 3 is obtained.

After the pressure medium is drained through line 4, tools 1, 2 are opened and the shaped part 11 can be removed.

As is evident from FIG. 3, the shaped part 11 has a relatively high border 12 which, in some cases, may be undesired so that shaped part 11 must still be trimmed after the shaping process. The material in border area 12 is scrap. To avoid this in one embodiment (not shown), shaping die 7 can be moved relative to the drawing ring 6. In this way it is possible to position the shaping die 7 for the preforming process in a reproducible fashion relative to parting plane 9. In addition, shaping die 7, after completion of the preforming process according to FIG. 2, is moved in the direction away from the parting plane 9 while the distance between the shaping die and the parting plane is reduced so that the degree of shaping in the outer area of preform part 10 is reduced and the unnecessary excess material 12 of FIG. 3 can be avoided to such an extent that the finished shaped part 11 need no longer be trimmed. In this case, the blank 8 shown in FIG. 7 can be shorter in the area where it is supported by the lower tool.

While the invention has been described in terms of its preferred embodiments, it should be understood that numerous modifications may be made thereto without departing from the spirit and scope of the invention as defined in the appended claims. It is intended that all such modifications fall within the scope of the appended claims.

I claim:

1. A method of shaping a sheet metal blank clamped in fluid tight fashion in a parting plane between an upper tool and a lower tool with one of the tools having a shaped outline with the sheet metal blank being formed into the shaped outline by a hydraulic pressure medium acting on a side of the sheet metal blank opposite the shaped outline comprising:

initially preforming the sheet metal blank under a controlled hydraulic pressure to produce a stretching of 10–15% beyond initial dimensions of the sheet metal blank; and with continued hydraulic pressure drawing the sheet metal blank without further stretching until the sheet metal blank has the shaped outline.

2. A method according to claim 1 wherein:

the shaped outline is adjusted at a beginning of the preforming of the sheet metal blank to a minimum distance from a parting plane of the tools so that the sheet metal blank contacts the shaped outline throughout an area during the preforming.

3. A method according to claim 1 wherein:

the shaped outline is moved in a direction away from a parting plane during the drawing of the sheet metal blank.

4. A method according to claim 2 wherein:

the shaped outline is moved in a direction away from a parting plane during the drawing of the sheet metal blank.

5. A method according to claim 1 wherein:

the sheet metal blank is clamped between the upper and lower tools during preforming and the clamping is released during drawing to a point where the sheet metal can move freely relative to where the tools have clamped the blank.

6. A method according to claim 2 wherein:

the blank is clamped between the upper and lower tools during preshaping and the clamping is released during drawing to a point where the sheet metal can move freely relative to where the tools have clamped the blank.

7. A method according to claim 3 wherein:

the blank is clamped between the upper and lower tools during preshaping and the clamping is released during drawing to a point where the sheet metal can move freely relative to where the tools have clamped the blank.

8. A method according to claim 4 wherein:

the blank is clamped between the upper and lower tools during preshaping and the clamping is released during drawing to a point where the sheet metal can move freely relative to where the tools have clamped the blank.

9. A method of shaping a sheet metal blank clamped in fluid tight fashion in a parting plane between an upper tool and a lower tool with one of the tools having a shaped outline with the sheet metal blank being formed into the shaped outline by a hydraulic pressure medium acting on a side of the sheet metal blank opposite the shaped outline comprising:

initially preforming the sheet metal blank under a controlled hydraulic pressure to produce a stretching in accordance with Hookes law beyond initial dimensions of the sheet metal blank until the blank contacts the one of the tools; and with continued hydraulic pressure drawing the sheet metal blank, without further stretching in accordance with Hookes law, until the sheet metal blank has the shaped outline.

10. A method according to claim 9 wherein the shaped outline is adjusted at a beginning of the preforming of the sheet metal blank to a minimum distance from a parting plane of the tools so that the sheet metal blank contacts the shaped outline throughout an area during the preforming.

11. A method according to claim 9 wherein:

the shaped outline is moved in a direction away from a parting plane during the drawing of the sheet metal blank; and the stretching is between 10–15% beyond initial dimensions of the sheet metal blank.

12. A method according to claim 10 wherein:

the shaped outline is moved in a direction away from a parting plane during the drawing of the sheet metal blank; and the stretching is between 10–15% beyond initial dimensions of the sheet metal blank.

13. A method according to claim 9 wherein:

the sheet metal blank is clamped between the upper and lower tools during preforming and the clamping is released during drawing to a point where the sheet metal can move freely relative to where the tools have clamped the blank.

14. A method according to claim 10 wherein:

the blank is clamped between the upper and lower tools during preshaping and the clamping is released during drawing to a point where the sheet metal can move freely relative to where the tools have clamped the blank.

15. A method according to claim 10 wherein:

the blank is clamped between the upper and lower tools during preshaping and the clamping is released during drawing to a point where the sheet metal can move freely relative to where the tools have clamped the blank.

16. A method according to claim 10 wherein:

the blank is clamped between the upper and lower tools during preshaping and the clamping is released during drawing to a point where the sheet metal an move freely relative to where the tools have clamped the blank.

* * * * *